US009719032B2

(12) United States Patent
Mori et al.

(10) Patent No.: US 9,719,032 B2
(45) Date of Patent: Aug. 1, 2017

(54) HYDROCARBON OIL PRODUCTION METHOD

(71) Applicant: JX NIPPON OIL & ENERGY CORPORATION, Tokyo (JP)

(72) Inventors: Hirotaka Mori, Tokyo (JP); Ryutaro Koide, Tokyo (JP); Yoshiaki Hukui, Tokyo (JP); Satoshi Takasaki, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 0 days.

(21) Appl. No.: 14/914,182

(22) PCT Filed: Jul. 11, 2014

(86) PCT No.: PCT/JP2014/068623

§ 371 (c)(1),
(2) Date: Feb. 24, 2016

(87) PCT Pub. No.: WO2015/029618

PCT Pub. Date: Mar. 5, 2015

(65) Prior Publication Data

US 2016/0200990 A1 Jul. 14, 2016

(30) Foreign Application Priority Data

Aug. 30, 2013 (JP) ..... 2013-180567

(51) Int. Cl.
*C10G 45/08* (2006.01)
*C10G 45/02* (2006.01)
*C10G 65/04* (2006.01)

(52) U.S. Cl.
CPC ..... *C10G 45/08* (2013.01); *C10G 45/02* (2013.01); *C10G 65/04* (2013.01); *C10G 2300/205* (2013.01)

(58) Field of Classification Search
CPC ..... C10G 45/02; C10G 45/08; C10G 65/04; C10G 2300/205
See application file for complete search history.

(56) References Cited

U.S. PATENT DOCUMENTS

2006/0060509 A1* 3/2006 Miyauchi ..... B01J 35/10 208/210

FOREIGN PATENT DOCUMENTS

JP H11-279566 A 10/1999
JP 2003-340281 A 12/2003
(Continued)

OTHER PUBLICATIONS

International Preliminary Report on patentability issued with respect to application No. PCT/JP2014/068623, mail date is Mar. 10, 2016.

(Continued)

*Primary Examiner* — Brian McCaig
(74) *Attorney, Agent, or Firm* — Greenblum & Bernstein, P.L.C.

(57) ABSTRACT

In the hydrocarbon oil production method, mixed oil containing atmospheric residue and deasphalted oil is brought into contact with a demetallizing catalyst in the presence of a hydrogen gas, and the mixed oil subjected to the demetallizing process is brought into contact with a desulfurizing catalyst in the presence of a hydrogen gas. The demetallizing catalyst optionally includes a low-reactivity catalyst. A part of a metallic composition contained in the mixed oil is a decomposable metallic composition. The amount of vanadium in the decomposable metallic composition is x % relative to the amount of vanadium in a whole vanadium-containing compound, the volume of the low-reactivity catalyst is y vol % relative to the total demetallizing catalyst:

Figure 1:
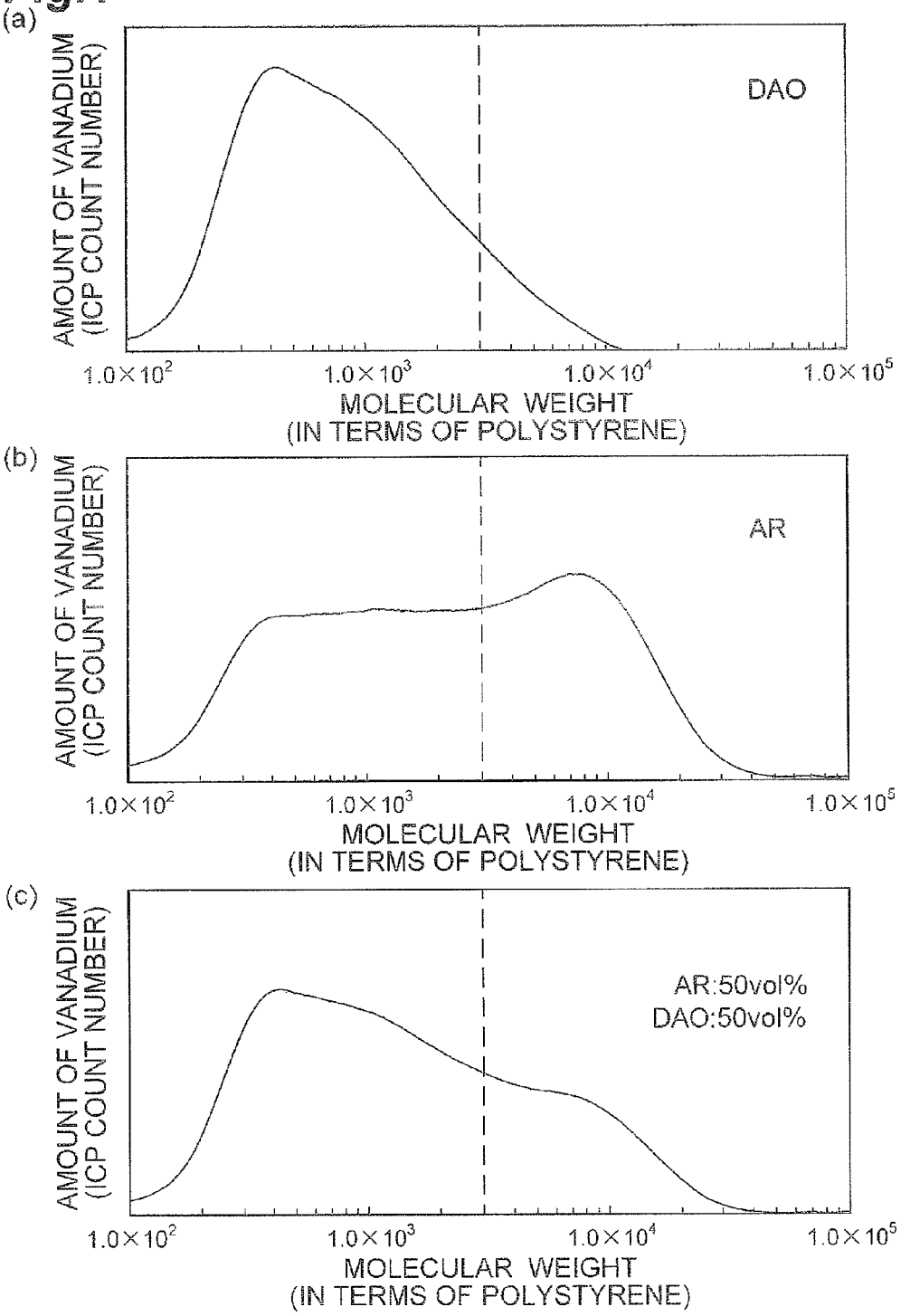

$0<x100$, $0<y\leq100$, and $x-50\leq y2.6x-99$.

7 Claims, 2 Drawing Sheets

(56) References Cited

FOREIGN PATENT DOCUMENTS

| | | | |
|---|---|---|---|
| JP | 2008-093493 | | 4/2008 |
| JP | 2010-201281 | | 9/2010 |
| JP | 2012-197350 | A | 10/2012 |
| WO | 02/34865 | A1 | 5/2002 |

OTHER PUBLICATIONS

International Search Report issued with respect to application No. PCT/JP2014/068623, mail date is Oct. 14, 2014.

* cited by examiner

HYDROCARBON OIL PRODUCTION METHOD

TECHNICAL FIELD

The present invention relates to a hydrocarbon oil production method.

BACKGROUND ART

In a petroleum refining process, bottom oil (atmospheric residue, AR) can be obtained by atmospheric distillation of crude petroleum. Each of the atmospheric residue and vacuum gas oil (VGO) obtained by vacuum distillation of the atmospheric residue is subjected to a desulfurization treatment or a catalytic cracking treatment, and thus products such as gasoline, lubricant base oil, or other chemicals can be obtained. Meanwhile, the vacuum residual oil obtained by the vacuum distillation of the atmospheric residue is a low-margin product compared to the above products. Accordingly, it is preferable to produce higher-margin products from the vacuum residual oil.

In the following Patent Literature 1, a technique is disclosed in which oil deasphalted by solvent (DAO: deasphalted oil) obtained by deasphalting of vacuum residual oil is mixed with atmospheric residue and/or vacuum gas oil, thereby preparing mixed oil, and the mixed oil is subjected to hydrorefining to produce a fuel such as gasoline.

CITATION LIST

Patent Literature

Patent Literature 1: Japanese Patent Application Laid-Open Publication No. 2012-197350

SUMMARY OF INVENTION

Technical Problem

Generally, hydrorefining of raw oil includes a demetallizing process and a subsequent desulfurizing process. In the demetallizing process, mixed oil is brought into contact with a demetallizing catalyst and is thus subjected to hydrogenation, so that a metallic composition (catalyst poison) causing deterioration of the desulfurizing catalyst is removed from the raw oil. In the desulfurizing process, the raw oil subjected to the demetallizing process is brought into contact with the desulfurizing catalyst and is then subjected to hydrogenation, so that a sulfur content is removed from the raw oil.

As a result of studies by the present inventors, it has been found in the hydrorefining of the mixed oil containing the atmospheric residue and the deasphalted oil that activity (demetallizing activity) of the demetallizing catalyst used to remove the metallic composition early reaches the lower limit contrary to expectation and desulfurizing activity of the desulfurizing catalyst is also rapidly reduced by following deactivation of the demetallizing catalyst.

The present invention has been made in view of the above problems of the prior art, and an object thereof is to provide a hydrocarbon oil production method that can suppress deactivation of the desulfurizing catalyst.

Solution to Problem

An aspect of a hydrocarbon oil production method according to the present invention includes: a demetallizing process in which mixed oil containing atmospheric residue and deasphalted oil is brought into contact with a demetallizing catalyst in the presence of a hydrogen gas; and a desulfurizing process in which the mixed oil subjected to the demetallizing process is brought into contact with a desulfurizing catalyst in the presence of a hydrogen gas, wherein the demetallizing catalyst includes at least a low-reactivity catalyst, the low-reactivity catalyst has a porous carrier and a Group VI element supported on the carrier, a content of the Group VIII element is 0 mass % or more based on a catalyst mass in the low-reactivity catalyst, a volume ratio of a high-reactivity catalyst is 0 vol % or more relative to the total demetallizing catalyst, the high-reactivity catalyst has a porous carrier and a Group VI element and a Group VIII element supported on the carrier, the content of the Group VIII element based on the catalyst mass in the low-reactivity catalyst is lower than a content of the Group VIII element based on the catalyst mass in the high-reactivity catalyst, the mixed oil contains a compound containing vanadium (vanadium-containing compound), a part of the vanadium-containing compound is a decomposable metallic composition having a molecular weight of 3000 or less, which is measured by gel permeation chromatography, and when the amount of vanadium to be contained hi the decomposable metallic composition is x % relative to the amount of vanadium to be contained in the whole vanadium-containing compound and the volume ratio of the low-reactivity catalyst is y vol % relative to the total demetallizing catalyst, the following inequality expression is established:

$$0<x<100,$$

$$0<y\leq 100, \text{ and}$$

$$x-50<y<2.6x-99.$$

Preferably, a content of the Group VI element based on the catalyst mass in the low-reactivity catalyst is lower than a content of the Group VI element based on the catalyst mass in the high-reactivity catalyst.

Preferably, the Group VI element is at least one of molybdenum or tungsten, and the Group VIII element is at least one of nickel or cobalt.

Preferably, a content of a Group VI element oxide based on a catalyst mass in the low-reactivity catalyst is from 1 mass % to less than 8 mass %, and a content of a Group VIII element oxide based on a catalyst mass in the low-reactivity catalyst is from 0 mass % to less than 1 mass %.

Preferably, in the demetallizing process, a reaction temperature is from 350 to 450° C., a partial pressure of the hydrogen gas is from 5 to 25 MPa, a liquid hourly space velocity (LHSV) is from 0.1 to 3.0 $h^{-1}$, and a hydrogen/oil ratio (ratio of the volume of hydrogen gas relative to the volume of mixed oil) is from 400 to 1500 $Nm^3/m^3$.

Preferably, in the desulfurizing process, a reaction temperature is from 350 to 450° C., a partial pressure of the hydrogen gas is from 5 to 25 MPa, a liquid hourly space velocity is from 0.1 to 3.0 $h^{31\ 1}$, and a hydrogen/oil ratio is from 400 to 1500 $Nm^3/m^3$.

Advantageous Effects of Invention

According to the present invention, it is possible to provide a hydrocarbon oil production method that can suppress deactivation of a desulfurizing catalyst.

BRIEF DESCRIPTION OF DRAWINGS a of FIG. 1 illustrates molecular weight distribution of a vanadium-containing compound contained in deasphalted oil, b of FIG. 1 illustrates molecular weight distribution of a vanadium-containing compound contained in atmospheric residue, and c of FIG. 1 illustrates molecular weight distribution of a vanadium-containing compound in mixed oil of atmospheric residue and deasphalted oil.

Figure 2:
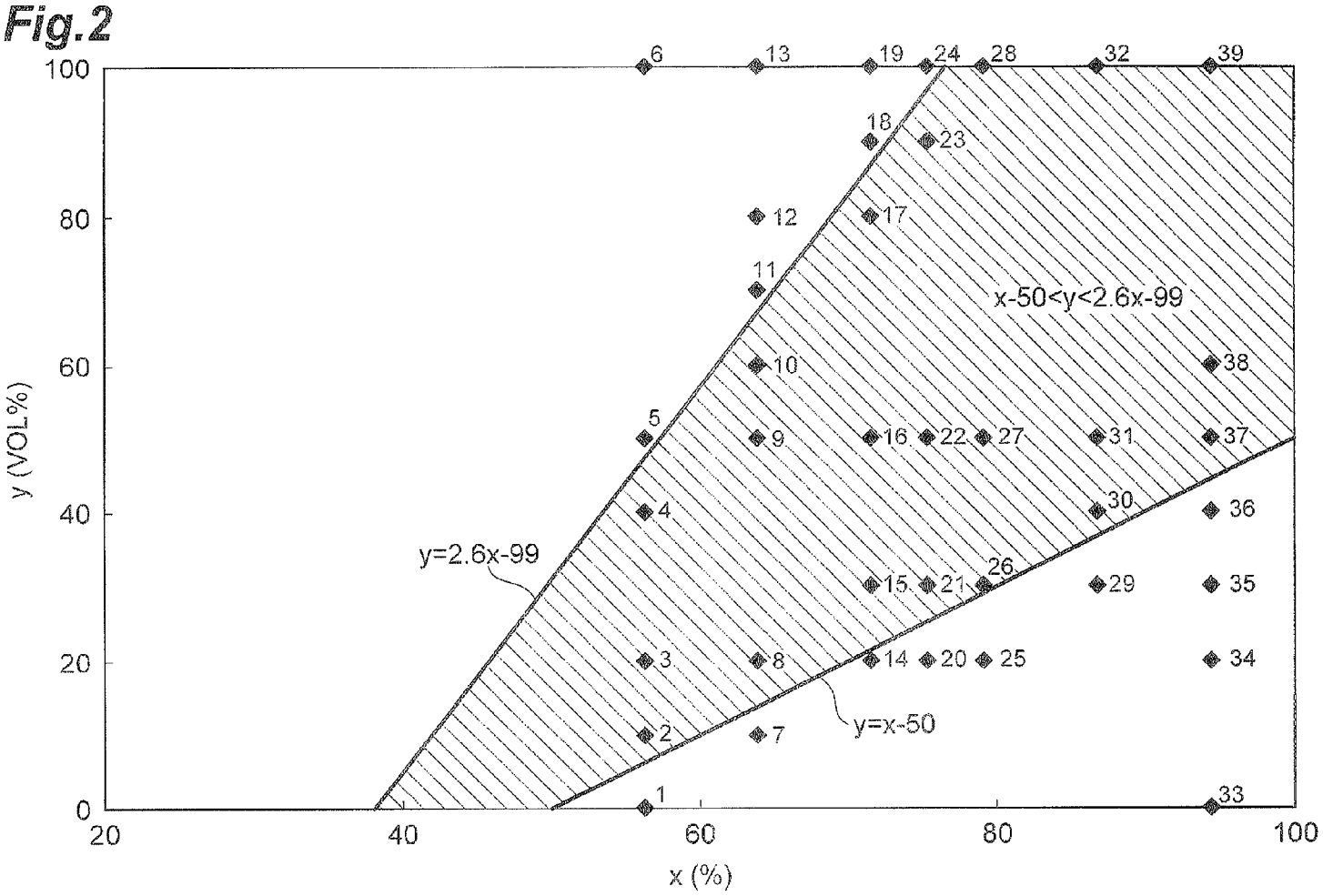

FIG. 2 illustrates a relation between a ratio of the amount of vanadium contained in a decomposable metallic composition to the amount of vanadium contained in a whole vanadium-containing compound in mixed oil (ratio of the amount of vanadium contained in the decomposable metallic composition) and a volume ratio of a low-reactivity catalyst relative to the total demetallizing catalyst.

DESCRIPTION OF EMBODIMENTS

Preferred embodiments of the present invention will be described below in detail. However, the present invention is not limited to the following embodiments.

In a hydrocarbon oil production method according to the present embodiment, bottom oil (atmospheric residue) is obtained by atmospheric distillation of crude petroleum. A type of crude petroleum is not particularly limited. Specific examples of the crude petroleum may include petroleum-based crude oil, synthetic crude petroleum derived from oil sand, and bitumen reformed oil. The atmospheric residue is heavy oil in which the content of fraction having a boiling point of 343° C. or higher is 80 mass % or more.

A part of the atmospheric residue obtained by the atmospheric distillation is subjected to vacuum distillation, thereby obtaining vacuum gas oil and vacuum residual oil. In the present embodiment, the atmospheric residue is intended to imply the vacuum gas oil and the vacuum residual oil.

By desulfurization (for example, hydrogenating desulfurization) of the vacuum gas oil and fluid catalytic cracking or hydrocracking after the desulfurization, hydrocarbon oil can be obtained.

A deasphalted oil is obtained by deasphalting of the vacuum residual oil. The deasphalted oil is a fraction obtained by extracting heavy oil (for example, vacuum residual oil), in which the content of fraction having a boiling point of 550° C. or higher is 70 mass % or more, using a solvent in the deasphalting. As the solvent used in the deasphalting, a chain-like saturated hydrocarbon having 3 to 6 carbon atoms may be used. As a specific example, the solvent may include propane, normal butane, isobutane, normal pentane, isopentane, and normal hexane. These solvents may be used singly or in combination of several kinds.

The remainder of the atmospheric residue (atmospheric residue which has not been subjected to the vacuum distillation) and the deasphalted oil are mixed with each other, and thus mixed oil is prepared. The mixed oil may be prepared by mixing of the vacuum gas oil with the deasphalted oil.

Since the mixed oil contains metallic compositions, a demetallizing process and a subsequent desulfurizing process are performed using the mixed oil. In the demetallizing process, the mixed oil is brought into contact with a demetallizing catalyst in the presence of hydrogen gas. As a result, the metallic compositions contained in the mixed oil are removed. In the desulfurizing process, the mixed oil subjected to the demetallizing process is brought into contact with a desulfurizing catalyst in the presence of hydrogen gas. As a result, sulfur contents (and nitrogen contents) contained in the mixed oil are removed. By fluid catalytic cracking or hydrocracking of the mixed oil subjected to the demetallizing process and the desulfurizing process, hydrocarbon oil can be obtained.

The metallic compositions to be a catalyst poison for the desulfurizing catalyst are removed from the mixed oil in the demetallizing process, whereby it is possible to suppress deactivation of the desulfurizing catalyst in the desulfurizing process and prolong life time of the desulfurizing catalyst.

In the following, the demetallizing process and the desulfurizing process will be described in detail.

A metal containing compound is a material containing vanadium and hydrocarbon. The structure of the metal containing compound is not particularly limited. For example, hydrocarbon and vanadium may form a chemical bond (for example, coordinate bond) or particulate vanadium may be coated with hydrocarbons. The metal containing compound may include nickel in addition to vanadium. The hydrocarbon is not particularly limited, but, for example, may include a chain-like hydrocarbon or an isomer thereof, a cyclic hydrocarbon, a heterocyclic compound, or an aromatic hydrocarbon. As a molecular weight of the metal containing compound becomes smaller, hydrogenation or cracking of the metal containing compound easily proceeds due to the demetallizing catalyst, and metal is easily removed from the metal containing compound. The metal removed from the metal containing compound in the demetallizing process is incorporated into innumerable pores formed in the demetallizing catalyst.

As described above, as the molecular weight of the metal containing compound (for example, vanadium-containing compound) becomes smaller, the metal is easily incorporated into the demetallizing catalyst. In the following, a metal containing compound (for example, vanadium-containing compound) having a molecular weight of 3000 or smaller is referred to as a "decomposable metallic composition". Meanwhile, a metal containing compound (for example, vanadium-containing compound) having a molecular weight of larger than 3000 is referred to as a "persistent metallic composition". The molecular weight of the metal containing compound (for example, vanadium-containing compound) is measured by Gel Permeation Chromatography (GPC) as will be described below.

a of FIG. 1 illustrates molecular weight distribution (hereinafter, referred to as "DAO distribution") of a vanadium-containing compound contained in deasphalted oil. The DAO distribution is obtained by the following experiment which has been performed by the inventors.

In the experiment, mixed oil is fractionated depending on differences in molecular weight, using GPC. The molecular weight of the fractionated individual compositions is identified based on a calibration curve obtained using polystyrene as a reference sample. That is, the molecular weight of fractionated individual compositions is a molecular weight (relative molecular weight) in terms of polystyrene. The amount of vanadium contained in each composition fractionated by the GPC is quantified by inductively coupled plasma (ICP) atomic emission spectrometry. That is, the mass (or the number of moles) of the vanadium contained in each metallic composition fractionated based on the molecular weight of the vanadium-containing compound is identified. Meanwhile, the mass (or the number of moles) of vanadium contained in all metallic compositions before being fractionated by the GPC is quantified by analysis of the mixed oil itself (for example, ICP atomic emission spectrometry). In a of FIG. 1, an abscissa indicates a value based on the GPC which is a molecular weight of the vanadium-containing compound. The scale of the abscissa indicates a logarithmic scale. In a of FIG. 1, an ordinate indicates a value corresponding to the mass (or the number of moles) of vanadium measured by the ICP atomic emission spectrometry and indicates the amount of vanadium at each molecular weight indicated on the abscissa.

b of FIG. 1 illustrates molecular weight distribution (hereinafter, referred to as "AR distribution") of a vanadium-containing compound contained in atmospheric residue. Similarly to the DAO distribution, the AR distribution is obtained by the inventors based on the GPC and the ICP atomic emission spectrometry with respect to the atmospheric residue.

c of FIG. 1 illustrates molecular weight distribution (hereinafter, referred to as "AR-DAO distribution") of a vanadium-containing compound in mixed oil of atmospheric residue and deasphalted oil. A volume ratio between the atmospheric residue and the deasphalted oil contained in the mixed oil is 1:1. Similarly to the DAO distribution and the AR distribution, the AR-DAO distribution is obtained by the inventors based on the GPC and the ICP atomic emission spectrometry with respect to the mixed oil. An area of the AR-DAO distribution (an integral value of the amount of vanadium contained in each composition which has been fractionated) corresponds to the total amount of vanadium.

The DAO distribution illustrated in a of FIG. 1 has one peak at a small molecular weight. In addition, the DAO distribution indicates that the amount of the metallic composition (vanadium composition) is small in a region where the molecular weight is large. That is, the DAO distribution indicates that most of the metallic compositions (vanadium composition) contained in the deasphalted oil is a decomposable metallic composition. Meanwhile, the AR distribution illustrated in b of FIG. 1 indicates that a large amount of metallic compositions (vanadium composition) exists over a region having a large molecular weight from a region having a small molecular weight, in contrast to the DAO distribution. That is, the AR distribution indicates that the atmospheric residue contains a large amount of persistent metallic compositions as well as a decomposable metallic composition in contrast to the DAO distribution. Furthermore, the AR-DAO distribution indicates that the amount of persistent metallic compositions contained in the mixed oil is larger than that contained in the deasphalted oil, but is smaller than that contained in the atmospheric residue.

The inventors found that demetallizing activity of the demetallizing catalyst was reduced, from the fact that the mixed oil contained the decomposable metallic composition as well as the persistent metallic composition.

When hydrogenating activity of the demetallizing catalyst used in the demetallizing process is too high, hydrogenation of the decomposable metallic composition excessively proceeds on the surface of the demetallizing catalyst for a short period of time. As a result, an excessive amount of metal (vanadium and the like) derived from the decomposable metallic composition is deposited near the surface of the demetallizing catalyst for a short period of time and thus the metal blocks entrances of the pores formed in the demetallizing catalyst, whereby the metal is hardly incorporated into the pores of the catalyst. That is, when the hydrogenating activity of the demetallizing catalyst is too high, the demetallizing activity is rapidly reduced for a short period of time, and thus the metallic composition is difficult to be removed from the mixed oil. As a result, due to the metallic composition remaining in the mixed oil, deactivation of the desulfurizing catalyst occurs in the desulfurizing process after the demetallizing process.

The inventors have clarified by experiments that the metal is deposited not only near the surface of the high-reactivity catalyst but also inside the high-reactivity catalyst when atmospheric residue having a low content of decomposable metallic composition is brought into contact with a demetallizing catalyst having high hydrogenating activity (high-reactivity catalyst). In addition, the inventors have clarified by experiments that the amount of metal deposited near the surface of the high-reactivity catalyst is significantly greater than the amount of metal deposited inside the high-reactivity catalyst when deasphalted oil having a high content of decomposable metallic composition is brought into contact with the high-reactivity catalyst. By these experiment results, a mechanism of the deactivation of the demetallizing catalyst is proved.

Then, the inventors found the following demetallizing catalyst hard to deactivate, based on the above findings on the relation between the molecular weight of the vanadium-containing compound and the deactivation of the demetallizing catalyst.

The demetallizing catalyst according to the present embodiment includes at least a low-reactivity catalyst. The low-reactivity catalyst is a catalyst having lower hydrogenating activity than that of the high-reactivity catalyst that is suitable for the demetallizing process of the atmospheric residue. Meanwhile, a volume ratio of the high-reactivity catalyst is 0 vol % or more relative to the total demetallizing catalyst. That is, the demetallizing catalyst may be made from only a low-reactivity catalyst and may not contain a high-reactivity catalyst. When the amount (mass or the number of moles) of vanadium to be contained in the decomposable metallic composition is represented as "x (x mass % or x mol %)" relative to the amount of vanadium to be contained in the whole vanadium-containing compound and a volume of the low-reactivity catalyst is represented as "y vol %" relative to the total demetallizing catalyst, the following inequality expression is established. The following inequality expression is deduced for the first time based on experiments of the inventors. The above "x" is a value obtained by dividing the amount (mass or the number of moles) of vanadium to be contained in the decomposable metallic composition fractionated by the GPC by the amount of vanadium to be contained in the whole vanadium-containing compound. The amount of vanadium to be contained in the decomposable metallic composition and the amount of vanadium to be contained in the whole vanadium-containing compound are measured by ICP atomic emission spectrometry or the like, respectively. In the following, the value "x" is also referred to as a "ratio of vanadium to be contained in the decomposable metallic composition".

$$0<x<100,$$

$$0<y\leq 100, \text{ and}$$

$$x-50<y<2.6x-99.$$

In the present embodiment, since the volume ratio "y" of the low-reactivity catalyst in the demetallizing catalyst is within the above range, the hydrogenating activity of the total demetallizing catalyst is moderately mitigated, and a phenomenon is suppressed that the hydrogenation of the decomposable metallic composition contained in the mixed oil rapidly proceeds on the surface of the demetallizing catalyst. As a result, the phenomenon is suppressed that the excessive amount of metal derived from the metallic composition is deposited near the surface of the demetallizing catalyst for a short period of time, and thus the entrances of the pores formed in the demetallizing catalyst are hardly blocked by the metal. In the present embodiment, accordingly, the metal is easily incorporated into the pores of the catalyst over a long period of time, and the metallic composition is easily removed from the mixed oil. Consequently, the metallic composition hardly remains in the mixed oil subjected to the demetallizing process, and the phenomenon of the deactivation of the desulfurizing catalyst due to the metallic composition is suppressed in the desulfurizing process. That is, the life time of the desulfurizing catalyst is prolonged.

The volume ratio "y" of the low-reactivity catalyst suitable to suppress the deactivation of the desulfurizing catalyst can be identified for the first time, based on the ratio "x" of the vanadium to be contained in the decomposable metallic composition, as represented by the above inequality expression. It is difficult to merely determine the ratio "y" based on only the volume ratio of the atmospheric residue and the deasphalted oil contained in the mixed oil. This is because the content of decomposable metallic composition contained in each of the atmospheric residue and the deasphalted oil varies depending on a type or a refining method of crude petroleum being a stating material and the ratio "x" of the vanadium contained in the decomposable metallic composition of the mixed oil does not necessarily depend on only the volume ratio between the atmospheric residue and the deasphalted oil contained in the mixed oil.

When the demetallizing catalyst includes both of the low-reactivity catalyst and the high-reactivity catalyst, the demetallizing catalyst is preferably provided with a low-reactivity catalyst portion (low-reactivity catalyst layer) including the low-reactivity catalyst and a high-reactivity catalyst portion (high-reactivity catalyst layer) including the high-reactivity catalyst. Then, the mixed oil preferably comes in contact with the high-reactivity catalyst portion after coming in contact with the low-reactivity catalyst portion. In this case, the phenomenon is suppressed that the hydrogenation of the decomposable metallic composition rapidly proceeds on the surface of the high-reactivity catalyst, and the entrances of the pores formed in the high-reactivity catalyst are hardly blocked by the metal.

The range of the ratio "x" of the vanadium contained in the decomposable metallic composition varies depending on a type or a refining method of crude petroleum being a starting material or the volume ratio between the atmospheric residue and the deasphalted oil contained in the mixed oil, and is not particularly limited. For example, the ratio "x" may satisfy a range of $56<x<94$ or $64<x<87$.

In the mixed oil, the volume ratio of the atmospheric residue and the volume ratio of the deasphalted oil are not particularly limited. The volume ratio of the atmospheric residue contained in the mixed oil may be, for example, from more than 0 vol % to less than 100 vol %, from 5 to 95 vol %, from 10 to 90 vol %, from 20 to 80 vol %, from 30 to 70 vol %, from 40 to 60 vol %, or from 45 to 55 vol %. The volume ratio of the deasphalted oil contained in the mixed oil may be, for example, from more than 0 vol % to less than 100 vol %, from 5 to 95 vol %, from 10 to 90 vol %, from 20 to 80 vol %, from 30 to 70 vol %, from 40 to 60 vol %, or from 45 to 55 vol %.

The low-reactivity catalyst has a porous carrier and a Group VI element supported on the carrier. In the low-reactivity catalyst, the content of a Group VIII element is 0 mass % or more based on a catalyst mass. Meanwhile, the high-reactivity catalyst has a porous carrier and a Group VI element and a Group VIII element supported on the carrier. The content of the Group VIII element based on the catalyst mass in the low-reactivity catalyst is lower than the content of the Group VIII element based on the catalyst mass in the high-reactivity catalyst.

Since the hydrogenating activity of the low-reactivity catalyst having the composition as described above is lower than the hydrogenating activity of the high-reactivity catalyst having the composition as described above, the deactivation of the demetallizing catalyst and the desulfurizing catalyst can be suppressed as described above.

The porous carrier included in the low-reactivity catalyst or the high-reactivity catalyst is not particularly limited. As a specific example, the porous carrier may include an inorganic oxide such as alumina, silica, or silica-alumina. The carrier of the low-reactivity catalyst and the carrier of the high-reactivity catalyst may be equal to or different from each other. Each of the demetallizing catalysts preferably has a central pore size of from 10 to 50 nm. The central pore size refers to a pore size having an accumulative pore volume of V/2 in an accumulative pore volume curve obtained by accumulating the volume of each pore having a diameter when an accumulative pore volume of pores having a pore diameter of from 2 nm to less than 60 nm obtained by a nitrogen gas adsorption method is defined as V. When the central pore size is within the above range, the metal derived from the metallic composition is easily incorporated into the demetallizing catalyst, and the deactivation of the desulfurizing catalyst is easily suppressed. The pore volume of each demetallizing catalyst may be about from 0.5 to 1.5 $cm^3/g$. Each demetallizing catalyst may have BET specific surface area of about from 100 to 250 $m^2/g$.

The Group VI element described above belongs to a Short Periodic Table (Old Periodic Table), and corresponds to a Group 6 element on a Long Periodic Table (New Periodic Table) based on an IUPAC format. That is, the Group VI element is at least one selected from the group consisting of chromium, molybdenum, tungsten, and seaborgium. The Group VIII element described above belongs to a Short Periodic Table, and corresponds to a Group 8 element, a Group 9 element, and a Group 10 element on the Long Periodic Table based on the IUPAC format. That is, the Group VIII element is at least one selected from the group consisting of iron, ruthenium, osmium, hassium, cobalt, rhodium, iridium, meitnerium, nickel, palladium, platinum, and damstadtium. The Group VI element included in the low-reactivity catalyst and the Group VI element included in the high-reactivity catalyst may be equal to or different from each other. The Group VIII element included in the low-reactivity catalyst and the Group VIII element included in the high-reactivity catalyst may be equal to or different from each other.

In the above aspect, the content of the Group VI element based on the catalyst mass in the low-reactivity catalyst is preferably lower than the content of the Group VI element based on the catalyst mass in the high-reactivity catalyst. In this case, the hydrogenating activity of the low-reactivity catalyst easily becomes lower than the hydrogenating activity of the high-reactivity catalyst.

The Group VI element included in the low-reactivity catalyst or the high-reactivity catalyst is preferably at least one of molybdenum or tungsten, and more preferably molybdenum. Since the low-reactivity catalyst or the high-reactivity catalyst includes such a Group VI element, the deactivation of the demetallizing catalyst and the desulfurizing catalyst is remarkably suppressed. The Group VIII element included in the low-reactivity catalyst or the high-reactivity catalyst is preferably at least one of nickel or cobalt, and more preferably nickel. Since the high-reactivity catalyst includes such a Group VIII element, the deactivation of the demetallizing catalyst and the desulfurizing catalyst is remarkably suppressed.

In the above aspect, the content of a Group VI element oxide based on a catalyst mass in the low-reactivity catalyst is preferably from 1 mass % to less than 8 mass %, and more preferably from 1 mass % to 6 mass %. The content of a Group VIII element oxide based on a catalyst mass in the low-reactivity catalyst is preferably from 0 mass % to less than 1 mass %. Since the lower limit of the content of the Group VI element oxide or the Group VIII element oxide in the low-reactivity catalyst is the above value, the low-reactivity catalyst can have sufficient hydrogenating activity. In addition, since the upper limit of the content of the Group VI element oxide or the Group VIII element oxide in the low-reactivity catalyst is the above value, rapid hydrogenation of the decomposable metallic composition is suppressed, and the demetallizing activity is easily maintained. The Group VI element oxide is, for example, $MoO_3$ or $WO_3$. The Group VIII element oxide is, for example, NiO or CoO.

The content of the Group VI element oxide based on the catalyst mass in the high-reactivity catalyst may be from 8 mass % to 30 mass %. The content of the Group VIII element oxide based on the catalyst mass in the high-reactivity catalyst may be from 1 mass % to 10 mass %. When the content of the Group VI element oxide or the Group VIII element oxide in the high-reactivity catalyst is within the above range, the effect of the present invention can be easily obtained.

The desulfurizing catalyst is not particularly limited. A desulfurizing catalyst having a porous carrier and an active metal supported on the carrier may be used. An example of the carrier to be used may include alumina, silica, or silica-alumina. An example of the active metal to be used may include at least one of a Group 5 element, a Group 6 element, a Group 8 element, a Group 9 element, and a Group 10 element. In particular, an example of the active metal may preferably include a combination of at least one of nickel or cobalt and at least one of molybdenum or tungsten. An example of a specific combination may include Ni—Mo, Co—Mo, or Ni—Co—Mo. The desulfurizing catalyst may have an average pore size of from about 8 to 12 nm. The desulfurizing catalyst may have the pore volume of from about 0.4 to 1.0 $cm^3/g$. The desulfurizing catalyst may have the BET specific surface area of from about 180 to 250 $m^2/g$.

The shape of the demetallizing catalyst and the desulfurizing catalyst is not particularly limited. The shape of each catalyst may be for example, a prismatic shape, a columnar shape, a three-leaf shape, a four-leaf shape, or a spherical shape. The size of each catalyst is not also particularly limited, but the demetallizing catalyst may have a particle size of from about 1 to 8 mm and the desulfurizing catalyst may have a particle size of from about 0.8 to 3.0 mm.

In the demetallizing process, the hydrogenating treatment (demetallizing) of the mixed oil is preferably performed under the following conditions.

Reaction temperature (temperature of the demetallizing catalyst): From 350 to 450° C., more preferably, from 350 to 410° C.

Partial pressure of hydrogen gas in a reaction field: From 5 to 25 MPa, more preferably, from 10 to 20 MPa.

Liquid hourly space velocity (LHSV): From 0.1 to 3.0 $h^{-1}$, more preferably, from 0.1 to 2.0 $h^{-1}$.

Hydrogen/Oil ratio: From 400 to 1500 $Nm^3/m^3$, more preferably, from 500 to 1200 $Nm^3/m^3$.

In the desulfurizing process, the hydrogenating desulfurization of the mixed oil is preferably performed under the following reaction conditions.

Reaction temperature (temperature of the desulfurizing catalyst): From 350 to 450° C., more preferably, from 350 to 430° C.

Partial pressure of hydrogen gas in a reaction field: From 5 to 25 MPa, more preferably, from 10 to 20 MPa.

Liquid hourly space velocity (LHSV): From 0.1 to 3.0 $h^{-1}$, more preferably, from 0.1 to 2.0 $h^{-1}$.

Hydrogen/Oil ratio: From 400 to 1500 $Nm^3/m^3$, more preferably, from 500 to 1200 $Nm^3/m^3$.

By performing the demetallizing process and the desulfurizing process under the above conditions, it is possible to easily suppress the deactivation of the demetallizing catalyst and the desulfurizing catalyst and reduce the concentration of the sulfur content contained in the mixed oil, which has been subjected to the desulfurizing process, to less than 0.6 mass %.

When the reaction temperature is equal to or higher than the above lower limit value in the demetallizing process or the desulfurizing process, the amount of sulfur content contained in the mixed oil, which has been subjected to the desulfurizing process, is easily reduced. When the reaction temperature is equal to or lower than the above upper limit value, coaking reaction is easily suppressed, and the differential pressure is hardly generated in a reactor (reaction column) in which the demetallizing process or the desulfurizing process is performed.

When the partial pressure of the hydrogen gas is equal to or more than the above lower limit value in the demetallizing process or the desulfurizing process, the demetallizing and the desulfurization reaction easily proceed, and the deactivation of the demetallizing catalyst and the desulfurizing catalyst is easily suppressed. When the partial pressure of the hydrogen gas is equal to or more than the above upper limit value, since the reaction column requires high pressure resistance or the amount of hydrogen gas to be consumed increases, the demetallizing process or the desulfurizing process has poor economic efficiency.

When the liquid hourly space velocity of the mixed oil is less than the above lower limit value in the demetallizing process or the desulfurizing process, the amount of mixed oil to be treated is small, and the demetallizing process or the desulfurizing process has poor economic efficiency. When the liquid hourly space velocity is equal to or less than the above upper limit value, the deactivation of the demetallizing catalyst and the desulfurizing catalyst hardly occurs, and the reaction temperature is easily maintained at a low level.

When the hydrogen/oil ratio is equal to or more than the above lower limit value, the deactivation of the demetallizing catalyst and the desulfurizing catalyst is easily suppressed. When the hydrogen/oil ratio is equal to or more than the upper limit value, a tendency to suppress the deactivation becomes gradual due to the increase of the hydrogen/oil ratio.

The above reaction conditions of the demetallizing process and the above reaction conditions of the desulfurizing process may be different from each other. After the demetallizing process is performed in a single reaction column, the desulfurizing process may be performed in a separate reaction column. The demetallizing catalyst and the desulfurizing catalyst are installed in the same reaction column, and the demetallizing process and the desulfurizing process may be continuously performed under the same reaction conditions. In this case, the demetallizing catalyst portion (demetallizing catalyst layer) including the demetallizing catalyst and the desulfurizing catalyst portion (desulfurizing catalyst layer) including the desulfurizing catalyst are provided, the mixed oil may be brought into contact with the desulfurizing catalyst portion after being brought into contact with the demetallizing catalyst portion.

EXAMPLE

The contents of the present invention will be described below with reference to Examples and Comparative Examples in more detail, but the present invention is not limited to the following Examples.

Experimental Example 8

<Preparation of Mixed Oil>

The following atmospheric residue and deasphalted oil were mixed with each other, thereby preparing mixed oil.

Properties of atmospheric residue used were as follows.

Content of sulfur: 3.4 mass %.

Content of vanadium: 58 mass ppm.

Content of nickel: 19 mass ppm.

Content of asphaltene: 4.2 mass %.

Density at 15° C.: 0.96 g/cm$^3$.

Kinematic viscosity at 100° C.: 34.8 mm$^2$/s.

Content of carbon residue: 9.47 mass %.

Content of nitrogen: 0.17 mass %.

Properties of deasphalted oil used were as follows.

Content of sulfur: 4.7 mass %.

Content of vanadium: 42 mass ppm.

Content of nickel: 21 mass ppm.

Content of asphaltene: 0.2 mass %.

Density at 15° C.: 1.01 g/cm$^3$.

Kinematic viscosity at 100° C.: 456 mm$^2$/s.

Content of carbon residue: 14.4 mass %.

Content of nitrogen: 0.24 mass %.

An analysis method of the properties of the atmospheric residue and the deasphalted oil is as follows.

Content of sulfur: JIS K2541 "Crude petroleum and petroleum products—Determination of sulfur content".

Content of vanadium: JIS K0116 "General rules for atomic emission spectrometry".

Content of asphaltene: IP-143 (ASTM D6560) "Determination of Asphaltenes in Crude Petroleum and Petroleum Products".

Density at 15° C.: JIS K2249 "Crude petroleum and petroleum products—Determination of density and Conversion method of density, mass, and volume".

Kinematic viscosity at 100° C.: JIS K2283 "Crude petroleum and petroleum products—Determination of kinematic viscosity and calculation of viscosity index from kinematic viscosity".

Content of carbon residue: JIS K2270 "Crude petroleum and petroleum products—Determination of carbon residue".

Content of nitrogen: JIS K2609 "Crude petroleum and petroleum products—Determination of nitrogen content".

A volume ratio of the atmospheric residue (AR) contained in the mixed oil was adjusted to be a value indicated in Table 1 below. A volume ratio of the deasphalted oil (DAO) contained in the mixed oil was adjusted to be a value indicated in Table 1 below.

A ratio x % of the amount of vanadium contained in a decomposable metallic composition in the mixed oil to the amount of vanadium contained in all vanadium-containing compounds in the mixed oil was measured by the GPC and the ICP atomic emission spectrometry described above. The ratio "x" in the mixed oil of Experimental Example 8 was a value indicated in Table 1 below. The GPC and the ICP atomic emission spectrometry were performed under the following conditions.

[Conditions of GPC]

Moving phase: Mixed solvent of tetrahydrofuran (THF) and o-xylene.

Volume ratio of the THF to the o-xylene in the moving phase: 30%: 70%.

Flow rate of a moving bed: 0.8 mL/min.

Measurement time: 20 min.

Kind of column: Shodex™ KF-G and KF-803.

Temperature of an oven in the column: 40° C.

RI attenuator: x 4.

RI polarity: +.

Device name: HP1100 manufactured by Agilent Technologies.

[Conditions of ICP Atomic Emission Spectrometry]

Observation height: 20.0 mm

RF output: 1.5 kW.

Voltage of photomultiplier: High.

Measurement wavelength: 309.311 nm.

Spectrometer: R.

A/D attenuator: 1/4.

* Device name: SPS3100 manufactured by SII Nano Technology Inc.

<Demetallizing Process and Desulfurizing Process>

As follows, the demetallizing catalyst and the desulfurizing catalyst were filled in a reaction column.

A first catalyst layer, a second catalyst layer, and a third catalyst layer were laminated in the reaction column in this order. The first catalyst layer is a layer that is formed by only a low-reactivity catalyst being the demetallizing catalyst. The second catalyst layer is a layer that is formed by only a high-reactivity catalyst being the demetallizing catalyst. The third catalyst layer is a layer that is formed by only the desulfurizing catalyst. A volume ratio "y" of the first catalyst layer (low-reactivity catalyst) relative to the total volume of the first catalyst layer and the second catalyst layer (total volume of the demetallizing catalyst) was adjusted to a value indicated in Table 1 below A volume ratio of the second catalyst layer (high-reactivity catalyst) relative to the total volume of the demetallizing catalyst was adjusted to a value indicated in Table 1 below. A volume of the third catalyst layer was equal to the total volume of the first catalyst layer and the second catalyst layer.

The low-reactivity catalyst was provided with porous γ-alumina and $MoO_3$ and NiO supported on the γ-alumina. The amount (content) of $MoO_3$ supported in the low-reactivity catalyst was 5.0 mass % relative to the total mass of the low-reactivity catalyst. The amount (content) of NiO supported in the low-reactivity catalyst was 0.5 mass % relative to the total mass of the low-reactivity catalyst. The central pore size of the low-reactivity catalyst (γ-alumina) was 18 nm. The BET specific surface area of the low-reactivity catalyst was 180 m$^2$/g.

The high-reactivity catalyst was provided with porous γ-alumina and $MoO_3$ and NiO supported on the γ-alumina. The amount (content) of $MoO_3$ supported in the high-reactivity catalyst was 9.0 mass % relative to the total mass of the high-reactivity catalyst. The amount (content) of NiO supported in the high-reactivity catalyst was 2.0 mass % relative to the total mass of the high-reactivity catalyst. The central pore size of the high-reactivity catalyst (γ-alumina) was 19 nm. The BET specific surface area of the high-reactivity catalyst was 180 m$^2$/g.

The desulfurizing catalyst was provided with porous γ-alumina and $MoO_3$ and NiO supported on the γ-alumina.

The amount (content) of $MoO_3$ supported in the desulfurizing catalyst was 12.0 mass % relative to the total mass of the desulfurizing catalyst. The amount (content) of NiO supported in the desulfurizing catalyst was 3.0 mass % relative to the total mass of the desulfurizing catalyst. The central pore size of the desulfurizing catalyst (γ-alumina) was 10 nm. The BET specific surface area of the desulfurizing catalyst was 230 $m^2/g$.

In the reaction column in which the hydrogen gas was present, the mixed oil was introduced into the first catalyst layer, the mixed oil passed through the first catalyst layer was introduced into the second catalyst layer, and the mixed oil passed through the second catalyst layer was introduced into the third catalyst layer. In this way, the demetallizing process and the desulfurizing process were continuously performed using the mixed oil. Reaction conditions of the demetallizing process and the desulfurizing process were as follows.

[Reaction Conditions]

Initial reaction temperature (temperature of each catalyst layer)

First catalyst layer and second catalyst layer (demetallizing catalyst): 360° C.

Third catalyst layer (desulfurizing catalyst): 370° C.

Partial pressure of the hydrogen gas in the reaction column: 14.4 MPa.

Liquid hourly space velocity of the mixed oil: 0.44 $h^{-1}$.

Hydrogen/Oil ratio: 900 $Nm^3/m^3$.

In the demetallizing process and the desulfurizing process, activity of the demetallizing catalyst and the desulfurizing catalyst is reduced with the lapse of time. For this reason, in the demetallizing process and the desulfurizing process, the activity of the demetallizing catalyst and the desulfurizing catalyst was supplemented in such a manner of heating the interior of the reaction column using a heater provided in the reaction column to increase the reaction temperature with the lapse of time. The activity of each catalyst was supplemented, and thus the amount of sulfur content contained in the mixed oil (mixed oil subjected to the demetallizing process and the desulfurizing process) passed through the third catalyst layer was maintained to less than 0.6 mass %. Then, the inventors measured the number of days until the reaction temperature reached 400° C., which was a heat-resistant temperature of the reaction column after the demetallizing process and the desulfurizing process started. The number of days is referred to as an absolute life time of the desulfurizing catalyst. In addition, a value obtained by dividing the absolute life time by 300 days is referred to as a relative life time of the desulfurizing catalyst. The absolute life time and the relative life time of the desulfurizing catalyst in Experimental Example 8 are indicated in Table 1 below Experimental Examples 1 to 7 and 9 to 39

In Experimental Examples 7 and 9 to 32, a volume ratio of the atmospheric residue (AR) contained in the mixed oil was adjusted to a value indicated in Table 1 below. In Experimental Examples 7 and 9 to 32, a volume ratio of the deasphalted oil (DAO) contained in the mixed oil was adjusted to a value indicated in Table 1 below. In Experimental Examples 1 to 6, only the atmospheric residue was used instead of the mixed oil. In Experimental Examples 33 to 39, only the deasphalted oil was used instead of the mixed oil.

Even in Experimental Examples 7 and 9 to 32, a ratio x % of the amount of vanadium contained in a decomposable metallic composition in the mixed oil to the amount of vanadium contained in all vanadium-containing compounds in the mixed oil was measured in the same manner as in Experimental Example 8. Furthermore, a ratio x % of the amount of vanadium contained in a decomposable metallic composition in the atmospheric residue, which is used in Experimental Examples 1 to 6, to the amount of vanadium contained in all vanadium-containing compounds in the atmospheric residue was measured in the same manner as in Experimental Example 8. In addition, a ratio x % of the amount of vanadium contained in a decomposable metallic composition in the deasphalted oil, which is used in Experimental Examples 33 to 39, to the amount of vanadium contained in all vanadium-containing compounds in the deasphalted oil was measured in the same manner as in Experimental Example 8. The ratio "x" measured in each of Experimental Examples was indicated in Table 1 below.

In Experimental Examples 1 to 7 and 9 to 39, a volume ratio "y" of a first catalyst layer (low-reactivity catalyst) relative to the total volume of the demetallizing catalyst was adjusted to a value indicated in Table 1 below. In Experimental Examples 1 to 7 and 9 to 39, a volume ratio of a second catalyst layer (high-reactivity catalyst) relative to the total volume of the demetallizing catalyst was adjusted to a value indicated in Table 1 below.

Except for the above matters, a demetallizing process and a desulfurizing process were performed in Experimental Examples 1 to 7 and 9 to 39 in the same manner as in Experimental Example 8. An absolute life time and a relative life time of the desulfurizing catalyst in Examples 1 to 7 and 9 to 39 measured in the same manner as in Experimental Example 8 are indicated in Table 1 below. A plot diagram of the values x and y for each Experimental Examples indicated in Table 1 below is illustrated in FIG. 2. In FIG. 2, a number given to each point represents number of Experimental Example indicated in Table 1. In Table 1, a symbol "V" represents a ratio of vanadium contained in the decomposable metallic composition relative to vanadium contained in the whole vanadium-containing compound.

TABLE 1

| | Volume ratio | | V | Volume ratio | | Desulfurizing catalyst | |
|---|---|---|---|---|---|---|---|
| | | | | Low-reactivity | High-reactivity | Absolute | Relative |
| Experimental Examples | AR Vol % | DAO Vol % | x % | catalyst (y) Vol % | catalyst Vol % | life time Day | life time — |
| 1 | 100 | 0 | 56 | 0 | 100 | 295 | 0.98 |
| 2 | 100 | 0 | 56 | 10 | 90 | 319 | 1.06 |
| 3 | 100 | 0 | 56 | 20 | 80 | 337 | 1.12 |
| 4 | 100 | 0 | 56 | 40 | 60 | 309 | 1.03 |
| 5 | 100 | 0 | 56 | 50 | 50 | 295 | 0.98 |

TABLE 1-continued

| | Volume ratio | | V | Volume ratio | | Desulfurizing catalyst | |
|---|---|---|---|---|---|---|---|
| | | | | Low-reactivity | High-reactivity | Absolute | Relative |
| Experimental Examples | AR Vol % | DAO Vol % | x % | catalyst (y) Vol % | catalyst Vol % | life time Day | life time — |
| 6 | 100 | 0 | 56 | 100 | 0 | 227 | 0.76 |
| 7 | 80 | 20 | 64 | 10 | 90 | 297 | 0.99 |
| 8 | 80 | 20 | 64 | 20 | 80 | 314 | 1.05 |
| 9 | 80 | 20 | 64 | 50 | 50 | 328 | 1.09 |
| 10 | 80 | 20 | 64 | 60 | 40 | 313 | 1.04 |
| 11 | 80 | 20 | 64 | 70 | 30 | 298 | 0.99 |
| 12 | 80 | 20 | 64 | 80 | 20 | 283 | 0.94 |
| 13 | 80 | 20 | 64 | 100 | 0 | 253 | 0.84 |
| 14 | 60 | 40 | 72 | 20 | 80 | 298 | 0.99 |
| 15 | 60 | 40 | 72 | 30 | 70 | 319 | 1.06 |
| 16 | 60 | 40 | 72 | 50 | 50 | 357 | 1.19 |
| 17 | 60 | 40 | 72 | 80 | 20 | 315 | 1.05 |
| 18 | 60 | 40 | 72 | 90 | 10 | 298 | 0.99 |
| 19 | 60 | 40 | 72 | 100 | 0 | 283 | 0.94 |
| 20 | 50 | 50 | 75 | 20 | 80 | 294 | 0.98 |
| 21 | 50 | 50 | 75 | 30 | 70 | 311 | 1.04 |
| 22 | 50 | 50 | 75 | 50 | 50 | 346 | 1.15 |
| 23 | 50 | 50 | 75 | 90 | 10 | 316 | 1.05 |
| 24 | 50 | 50 | 75 | 100 | 0 | 297 | 0.99 |
| 25 | 40 | 60 | 79 | 20 | 80 | 287 | 0.96 |
| 26 | 40 | 60 | 79 | 30 | 70 | 304 | 1.01 |
| 27 | 40 | 60 | 79 | 50 | 50 | 338 | 1.13 |
| 28 | 40 | 60 | 79 | 100 | 0 | 317 | 1.06 |
| 29 | 20 | 80 | 87 | 30 | 70 | 293 | 0.98 |
| 30 | 20 | 80 | 87 | 40 | 60 | 309 | 1.03 |
| 31 | 20 | 80 | 87 | 50 | 50 | 324 | 1.08 |
| 32 | 20 | 80 | 87 | 100 | 0 | 359 | 1.20 |
| 33 | 0 | 100 | 94 | 0 | 100 | 240 | 0.80 |
| 34 | 0 | 100 | 94 | 20 | 80 | 270 | 0.90 |
| 35 | 0 | 100 | 94 | 30 | 70 | 284 | 0.95 |
| 36 | 0 | 100 | 94 | 40 | 60 | 298 | 0.99 |
| 37 | 0 | 100 | 94 | 50 | 50 | 314 | 1.05 |
| 38 | 0 | 100 | 94 | 60 | 40 | 328 | 1.09 |
| 39 | 0 | 100 | 94 | 100 | 0 | 386 | 1.29 |

As illustrated in Table 1 and FIG. 2, it was confirmed that the absolute life time of the desulfurizing catalyst was 300 days or longer in Experimental Examples in which the value "y" was within a range of $x-50<y<2.6x-99$ and the relative life time thereof was 1 or longer. Meanwhile, it was confirmed that the absolute life time of the desulfurizing catalyst was shorter than 300 days in all Experimental Examples in which the value "y" was out of the range of $x-50<y<2.6x-99$ and the relative life time thereof was shorter than 1. That is, straight lines "$y=x-50$ and $y=2.6x-99$" illustrated in FIG. 2 are straight lines by which a distribution region of x and y in Experimental Examples where the absolute life time of the desulfurizing catalyst was 300 days or longer is divided from a distribution region of x and y in Experimental Examples where the absolute life time of the desulfurizing catalyst was shorter than 300 days, and are deduced by the inventors based on the above experiments. The relation between x and y illustrated in FIG. 2 is not limited to specific crude petroleum.

From the above, it was confirmed that the deactivation of the desulfurizing catalyst was suppressed in a case where the value "y" was within the range of $x-50<y<2.6x-99$, compared with a case where the value "y" was out of the range of $x-50<y<2.6x-99$. In view of the fact that the deactivation of the desulfurizing catalyst was caused by the deactivation of the demetallizing catalyst, it was confirmed that the deactivation of the demetallizing catalyst was suppressed in a case where the value "y" was within the range of $x-50<y<2.6x-99$, compared with a case where the value "y" was out of the range of $x-50<y<2.6x-99$.

INDUSTRIAL APPLICABILITY

A hydrocarbon oil production method according to the present invention is suitable to produce gasoline, lubricant base oil, other chemical products and the like using mixed oil of atmospheric residue and deasphalted oil as a raw material.

The invention claimed is:

1. A hydrocarbon oil production method, comprising:

a demetallizing process in which mixed oil containing atmospheric residue and deasphalted oil is brought into contact with a demetallizing catalyst in the presence of a hydrogen gas; and a desulfurizing process in which the mixed oil subjected to the demetallizing process is brought into contact with a desulfurizing catalyst in the presence of a hydrogen gas, wherein the demetallizing catalyst includes at least a low-reactivity catalyst and a high-reactivity catalyst, the low-reactivity catalyst is a catalyst having lower hydrogenating activity than that of the high-reactivity catalyst, the low-reactivity catalyst has a porous carrier and a Group VI element supported on the carrier, a content of a Group VIII element is 0 mass % or more based on a catalyst mass in the low-reactivity catalyst, a volume ratio of the high-reactivity catalyst is more than 0 vol % relative to the total demetallizing catalyst, the high-reactivity catalyst has a porous carrier and a Group VI element and a Group VIII element supported on the carrier, the content of the Group VIII element based on the catalyst mass in the low-reactivity catalyst is lower than a content of the Group VIII element based on the catalyst mass in the high-reactivity catalyst, the mixed oil contains a vanadium-containing component, a part of the vanadium-containing component is a decomposable metallic composition having a molecular weight of 3000 or less, which is measured by gel permeation chromatography, and wherein the amount of vanadium to be contained in the decomposable metallic composition is x % relative to the amount of vanadium to be contained in the vanadium-containing component and the volume ratio of the low-reactivity catalyst is y vol % relative to the total demetallizing catalyst, the following inequality expression is established:

$$0<x<100,$$

$$0<y<100, \text{ and}$$

$$x-50<y<2.6x-99.$$

2. The hydrocarbon oil production method according to claim 1, wherein a content of the Group VI element based on the catalyst mass in the low-reactivity catalyst is lower than a content of the Group VI element based on the catalyst mass in the high-reactivity catalyst.

3. The hydrocarbon oil production method according to claim 1, wherein the Group VI element in the low-reactivity catalyst and the high-reactivity catalyst is at least one of molybdenum or tungsten, and the Group VIII element in the low-reactivity catalyst and the high-reactivity catalyst is at least one of nickel or cobalt.

4. The hydrocarbon oil production method according to claim 1, wherein a content of a Group VI element oxide based on a catalyst mass in the low-reactivity catalyst is from 1 mass % to less than 8 mass %, and a content of a Group VIII element oxide based on a catalyst mass in the low-reactivity catalyst is from 0 mass % to less than 1 mass %.

5. The hydrocarbon oil production method according to claim 1, wherein, in the demetallizing process, a reaction temperature is from 350 to 450° C., a partial pressure of the hydrogen gas is from 5 to 25 MPa, a liquid hourly space velocity is from 0.1 to 3.0 $h^{-1}$, and a hydrogen/oil ratio is from 400 to 1500 $Nm^3/m^3$.

6. The hydrocarbon oil production method according to claim 1, wherein, in the desulfurizing process, a reaction temperature is from 350 to 450° C., a partial pressure of the hydrogen gas is from 5 to 25 MPa, a liquid hourly space velocity is from 0.1 to 3.0 $h^{-1}$, and a hydrogen/oil ratio is from 400 to 1500 $Nm^3/m^3$.

7. The hydrocarbon oil production method according to claim 1, wherein the content of a Group VI element oxide based on the catalyst mass in the high-reactivity catalyst is from 8 mass % to less than 30 mass %, and the content of a Group VIII element oxide based on the catalyst mass in the high-reactivity catalyst is from 1 mass % to less than 10 mass %.

* * * * *